US005762136A

United States Patent [19]

Oswald

[11] Patent Number: 5,762,136

[45] Date of Patent: Jun. 9, 1998

[54] WEAR BUSHING LOCKDOWN AND METHOD OF INSERTING

[75] Inventor: Iain MacPherson Oswald, Aberdeen, United Kingdom

[73] Assignee: Vetco Gray Inc., Houston, Tex.

[21] Appl. No.: 758,874

[22] Filed: Dec. 2, 1996

[51] Int. Cl.[6] ..... F21B 33/03

[52] U.S. Cl. ..... 166/85.3; 175/7; 285/322

[58] Field of Search ..... 166/85.3, 365, 166/335; 285/319, 322; 175/7

[56] References Cited

U.S. PATENT DOCUMENTS

| | | | |
|---|---|---|---|
| 3,227,229 | 1/1966 | Wakefield, Jr. | 166/75.11 X |
| 3,247,914 | 4/1966 | Slack | 166/85.3 X |
| 3,721,292 | 3/1973 | Ahlstone | 166/359 |
| 4,362,210 | 12/1982 | Green | 166/85.3 |
| 4,978,147 | 12/1990 | Henderson, Jr. et al. | 285/2 |
| 5,199,495 | 4/1993 | Brammer et al. | 166/339 |
| 5,360,063 | 11/1994 | Henderson, Jr. | 166/208 |

*Primary Examiner*—David J. Bagnell
*Attorney, Agent, or Firm*—James E. Bradley

[57] ABSTRACT

In this invention, a wear bushing has a lower tubular portion and an upper tubular portion. The lower portion has fingers on its upper end. The upper portion has a conical lower end that slides within the inner sides of the fingers. For running-in, the upper portion engages and mechanically locks with the lower portion with the fingers in an undeflected position. The lower portion will land on a stop in the bore. The upper portion continues downward, deflecting the fingers outward into a recess in the bore thereby preventing the upward movement of the wear bushing.

17 Claims, 2 Drawing Sheets

WEAR BUSHING LOCKDOWN AND METHOD OF INSERTING

TECHNICAL FIELD

This invention relates in general to offshore wellhead equipment, and in particular to a locking device for locking a drilling wear bushing within a bore.

BACKGROUND ART

There are instances in which an inner tubular member must be releasably locked into an outer tubular member within a well. For example, while drilling an offshore well with a jackup drilling rig, a wellhead housing will be located on a string of casing extending upward from the sea floor. The wellhead housing is located on a well deck, about 90 feet below the rig floor. A riser extends upward from the wellhead housing to the rig floor. The drilling rig will run drill pipe down through the wellhead housing for drilling. It is important to avoid damaging the bore of the wellhead housing and also the seal where it connects to the riser. Wear bushings are often employed to prevent damage from the rotating drill pipe.

The wear bushing needs to be retained in the bore and needs to be installed remotely by lowering through the riser. Without some type of retention mechanism, the wear bushing might be dislodged by circulation of heavy solids or by tripping of the drill pipe through the wellhead during normal drilling operations. If the wear bushing is dislodged, it could reposition itself in the blowout preventer stack and cause damage to or failure of the blowout preventer to shut in the well during a pressure "kick." This could subject the rig to a blowout, causing serious damage.

There are various mechanisms for retaining wear bushings, including shear pins, lock rings, or J-pins made of steel or other metallic alloys. While workable, users have experienced failure in activating or releasing these devices. It is difficult to recover the wear bushing if the locking mechanism fails to release.

DISCLOSURE OF INVENTION

In this invention, a wear bushing has a lower tubular portion and an upper tubular portion. The lower portion has fingers on its upper end. The upper portion has a conical lower end that slides within the inner sides of the fingers. For running-in, the upper portion engages and mechanically locks with the lower portion with the fingers in an undeflected position. The lower portion will land on a stop in the bore. The upper portion continues downward, deflecting the fingers outward into a recess in the bore, thereby preventing the upward movement of the wear bushing.

DETAILED DESCRIPTION OF THE INVENTION

Figure 1:
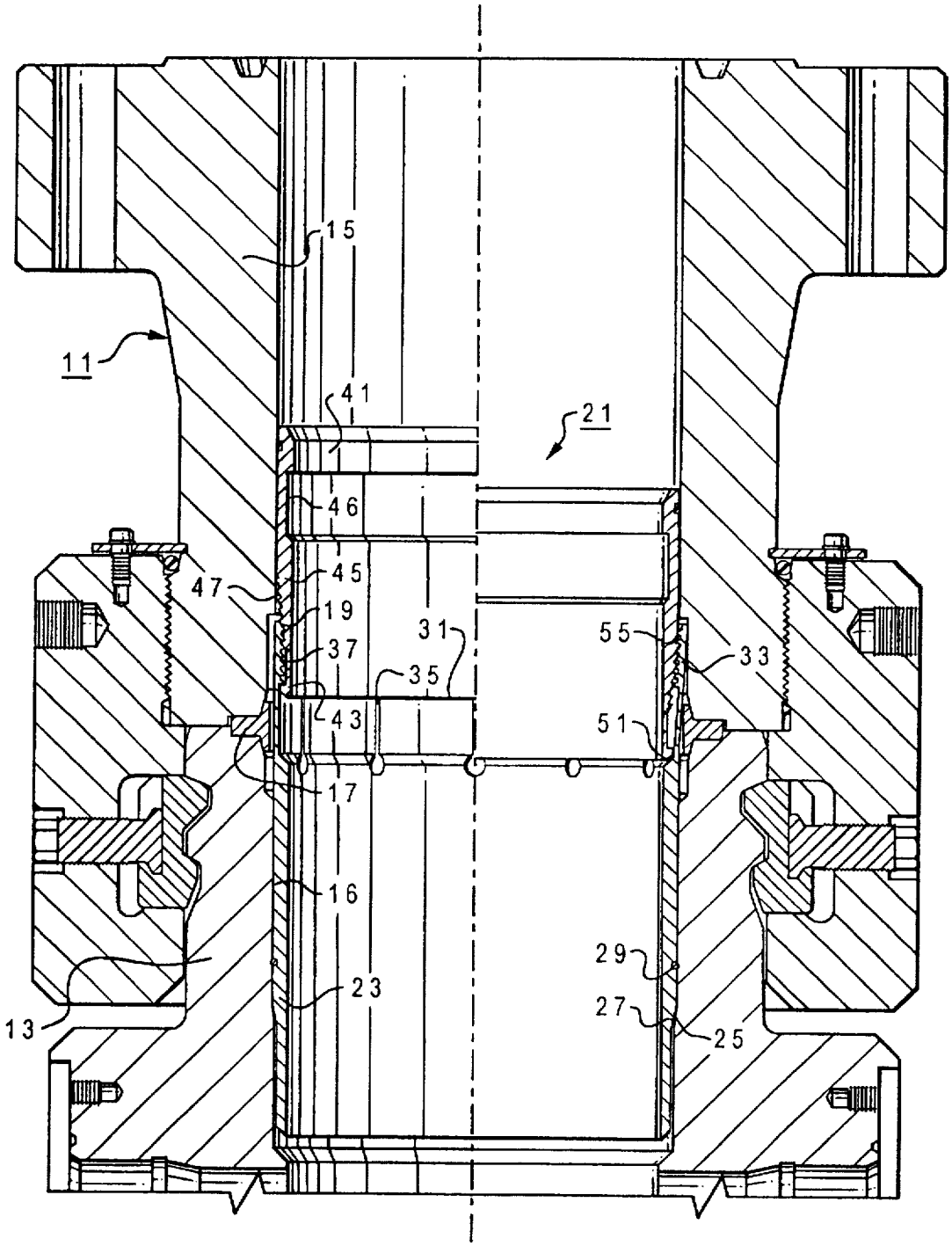
FIG. 1 is a half-sectional view of a wellhead demonstrating a first embodiment of the invention, showing, on the left side, the wear bushing being installed just prior to deflection of the fingers, and on the right side, the wear bushing in a fully installed position.

FIG. 1 shows a first embodiment of a wellhead system including a housing or spool 11 and a wellhead housing 13 located beneath spool 11. Housing 13 is supported on a jackup drilling rig on a string of casing extending upward from the sea floor. Spool 11 is a housing that forms the lower end of a riser leading upward 90 feet to the drilling floor. Spool 11 has a bore 15 and housing 13 has a bore 16. A seal 17 of conventional design locates between spool 11 and housing 13. Bore 15 has an inner diameter and an internal annular recess or profile 19.

A wear bushing 21 is located inward from seal 17. Wear bushing 21 has a tubular lower portion 23 with an external taper 25. Taper 25 lands on a taper 27 in bore 16 to limit downward motion of lower portion 23 of wear bushing 21. Pins 29 extend between lower portion 23 and bore 16 to prevent the rotation of lower portion 23 in bore 16. On an upper end 31 of lower portion 23 are a plurality of finger-like projections 33 which contain internal grooves or threads 37. Fingers 33 are spaced apart by slots 35 which extend downward from upper end 31.

Wear bushing 21 has a tubular upper portion 41 with a lower rim 43. Upper portion 41 has on its lower end a conical taper 45 and grooves or threads 47 on the exterior of taper 45. Taper 45 has an outer diameter that tapers radially inward along the length of upper portion 41. An inner groove 46 is adapted to be engaged by a running tool (not shown). As shown on the left side of FIG. 1, upper portion 41 has been lowered down into bore 15. When upper portion 41 is forced downward into lower portion 23, grooves 47 engage grooves 37, thereby preventing upward movement of upper portion 41. Prior to complete installation of upper portion 41, fingers 33 remain upright and undeflected. However, as upper portion 41 continues downward into lower portion 23, fingers 33 begin to deflect outwardly, as shown on the right side of FIG. 1. Upper portion 41 will cease downward motion when rim 43 of upper portion 41 lands on internal shoulder 51 of lower portion 23. At this point, fingers 33 have deflected outward into profile 19 and below a shoulder 55 at the upper end of recess 19, thereby preventing the upward motion of wear bushing 21.

In operation, spool 15 is clamped to wellhead housing 13 and an operator secures a running tool (not shown) to groove 46 in upper portion 41 of wear bushing 21 so that wear bushing 21 may be lowered into bore 15. While wear bushing 21 is being lowered into the well, grooves 47 on upper portion 41 engage grooves 37 on lower portion 23 so that upper portion 41 carries lower portion 23 with fingers 33 in an undeflected position. After lower portion 23 lands in bore 16, upper portion 41 continues its downward movement, thereby deflecting fingers 33 outward into profile 19 and beneath shoulder 51 so that upward movement of wear bushing 21 is prevented. Wear bushing 21 may also be retrieved from the wellhead. An upward overpull of sufficient force on upper portion 41 will cause upper portion 41 to disengage lower portion 23. When upper portion 41 disengages lower portion 23, fingers 33 return to an upright and undeflected position, thereby allowing both portions to be removed.

Figure 2:
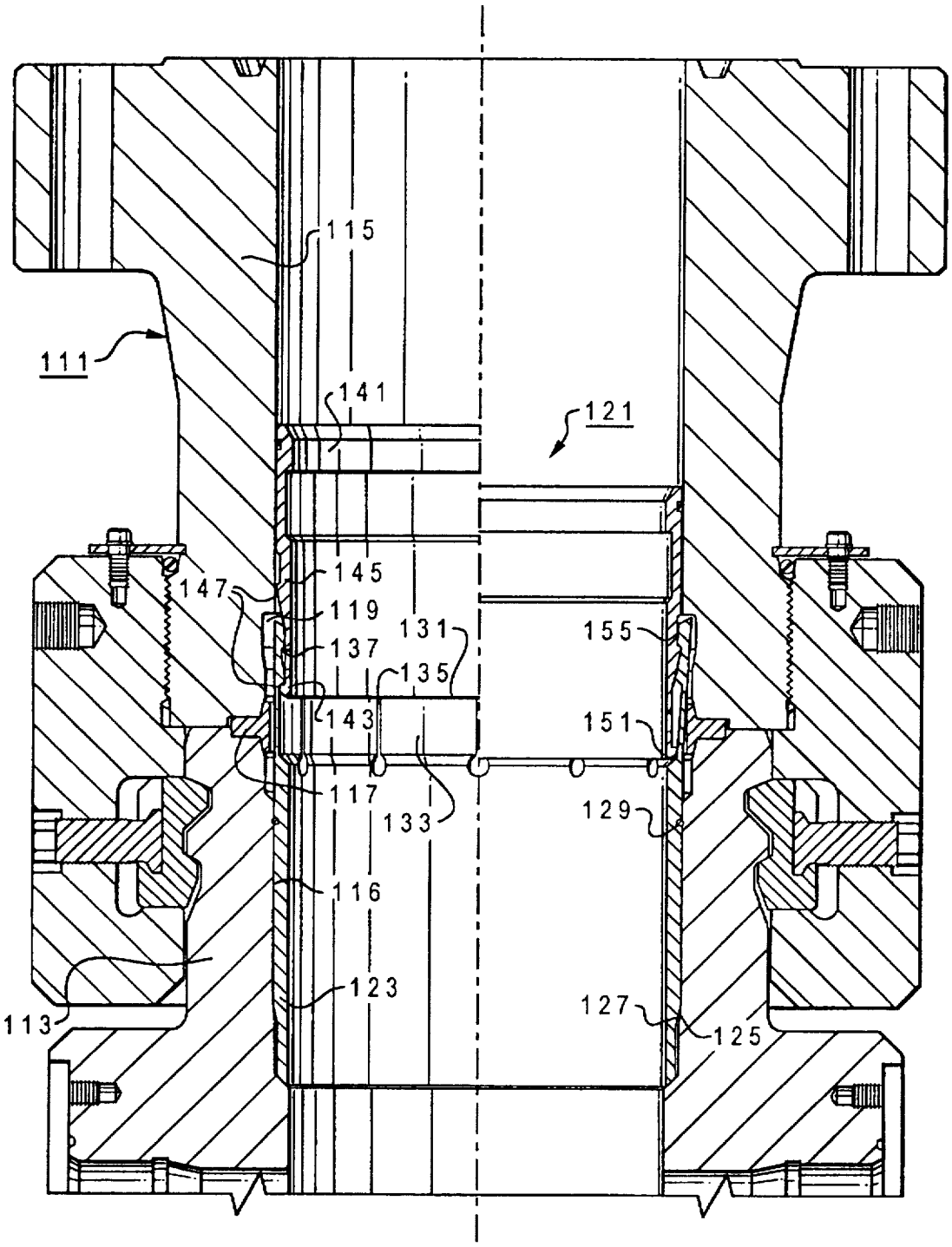
FIG. 2 is a half-sectional view of a subsea wellhead demonstrating a second embodiment of the invention, showing, on the left side, the wear bushing being installed just prior to deflection of the fingers, and on the right side, the wear bushing in a fully installed position.

FIG. 2 shows a second embodiment of a subsea wellhead system including a spool 111 and a lower wellhead housing 113 located beneath spool 111. Spool 111 has a bore 115 and housing 113 has a bore 116. A seal 117 of conventional design locates between spool 111 and housing 113. Bore 115 has an inner diameter and an internal annular recess or profile 119.

A wear bushing 121 is located inward from seal 117. Wear bushing 121 has a tubular lower portion 123 with an external taper 125. Taper 125 lands on a taper 127 in bore 116 to limit downward motion of lower portion 123 of wear bushing 121. Pins 129 extend between lower portion 123 and bore 116 to prevent the rotation of lower portion 123 in bore 116. On an upper end 131 of lower portion 123 are a plurality of finger-like projections 133 which contain internal grooves or detents 137. Fingers 133 are spaced apart by slots 135 which extend downward from upper end 131.

Wear bushing 121 has a tubular upper portion 141 with a lower rim 143. Upper portion 141 has on its lower end a conical taper 145 and groove or detents 147 on the exterior of taper 145. Taper 145 has an outer diameter that tapers radially inward along the length of upper portion 141. As shown on the left side of FIG. 2, upper portion 141 has been lowered down into bore 115. When upper portion 141 is forced downward into lower portion 123, detents 147 engage detents 137, thereby preventing upward movement of upper portion 141. Prior to complete installation of upper portion 141, fingers 133 remain upright and undeflected. However, as upper portion 141 continues downward into lower portion 123, fingers 133 begin to deflect outwardly, as shown on the right side of FIG. 1. Upper portion 141 will cease downward motion when rim 143 of upper portion 141 lands on internal shoulder 151 of lower portion 123. At this point, fingers 133 have deflected outward into profile 119 and below a recess 155, thereby preventing the upward motion of wear bushing 121.

Wear bushing 121 may also be retrieved from the wellhead. An upward overpull of sufficient force on upper portion 141 will cause upper portion 141 to disengage lower portion 123. When upper portion 141 disengages lower portion 123, fingers 133 return to an upright and undeflected position, thereby allowing both portions to be removed.

This invention has significant advantages. An inner tubular member can be lowered into and locked in an outer tubular member remotely. The outer tubular member needs only a recess, shoulder and a stop surface. No penetration through the wall of the outer housing is required to utilize the invention. In addition, the wear bushing is easily latched in place by a straight downward movement. The fingers also allow the wear bushing to be retrieved by an upward overpull. The two piece design allows the bushing to protect the profile by extending past the seal in both axial directions. These advantages avoid excessive wear in this portion of the bore.

While the invention has been shown in only two of its forms, it should be apparent to those skilled in the art that it is not so limited, but is susceptible to various changes without departing from the scope of the invention.

I claim:

1. In a well assembly having an outer tubular member with a bore and an inner tubular member which is lowered into and remotely locked to the outer member, comprising in combination:

an annular recess formed in the bore, the recess having a downward facing shoulder;

the inner tubular member having an upper portion and a lower portion;

the lower portion having an upper end containing a plurality of fingers, the fingers being spaced apart by slots extending downward from the upper end so as to allow radial deflection of the fingers between an undeflected running-in position and an outward deflected locked position;

stop means in the bore, below the shoulder, for engagement with the lower portion to limit downward movement of the lower portion in the bore when the inner tubular member is being run into the bore; and locking means for carrying the lower portion on the upper portion with the fingers in the running-in position while running the inner tubular member into the bore, and for allowing downward movement of the upper portion relative to the lower portion after the lower portion engages the stop means in the bore, causing the fingers to deflect outward into the recess below the shoulder to the locked position, thereby preventing upward movement of the inner tubular member.

2. The well assembly according to claim 1 wherein the inner tubular member comprises a wear bushing for protecting the bore of the outer tubular member.

3. The well assembly according to claim 1 wherein the outer tubular member comprises:

a lower tubular member;

an upper tubular member secured to an upper end of the lower tubular member; and wherein the shoulder is in the upper tubular member and the stop means is in the lower tubular member.

4. The well assembly according to claim 1 wherein the stop means in the bore comprises a tapered surface.

5. The well assembly according to claim 1 further comprising means for preventing rotation of the lower portion relative to the outer tubular member.

6. The well assembly according to claim 1 further comprising a pin in the bore to prevent rotation of the lower portion relative to the outer tubular member.

7. The well assembly according to claim 1 wherein the locking means further comprises:

a set of circumferentially extending grooves on an inner side of the fingers;

a set of circumferentially extending grooves on an outer side of a lower end of the upper portion for engagement with the grooves on the fingers; and wherein one of the sets of grooves has a tapered diameter from an upper edge to a lower edge of said set.

8. The well assembly according to claim 1 wherein the locking means further comprises:

a conical lower end on the upper portion, the lower end having at least one upward facing shoulder; and a downward facing shoulder on an inner surface on the fingers for engaging the upward facing shoulder on the upper portion.

9. In a well assembly having an outer tubular member with a bore and an inner tubular member which is lowered into and remotely locked to the outer member, comprising in combination:

an annular recess formed in the bore, the recess having a downward facing shoulder;

the inner tubular member having an upper portion and a lower portion;

the lower portion having an upper end containing a plurality of fingers, the fingers being spaced apart by slots extending downward from the upper end so as to allow radial deflection of the fingers between an undeflected running-in position and an outward deflected position;

stop means in the bore, below the shoulder, for engagement with the lower portion to limit downward movement of the lower portion in the bore when the inner tubular member is being run into the bore;

a conical section on an outer side of a lower end of the upper portion for engagement with an inner side of the fingers, such that when the upper portion is moved downward relative to the lower portion after the lower portion engages the stop means, the fingers deflect outward into the recess below the shoulder to the outward deflected position, thereby preventing upward movement of the inner tubular member; and, at least one locking shoulder on the conical section and on the inner side of the fingers for engaging each other to hold the upper portion in a lower position relative to the upper portion and hold the fingers in the outward deflected position.

10. The well assembly according to claim 9 wherein the inner tubular member comprises a wear bushing for protecting the bore of the outer tubular member.

11. The well assembly according to claim 9 wherein the stop means in the bore comprises a tapered surface.

12. The well assembly according to claim 9 further comprising at least one pin in the bore to prevent rotation of the lower portion of the inner tubular member.

13. The well assembly according to claim 9 wherein the outer tubular member comprises:

a wellhead housing;

a spool member secured to an upper end of the wellhead housing; and wherein the shoulder is in the spool member and the stop means is in the wellhead housing.

14. In a well assembly having an upper housing, a lower housing, a seal between the upper housing and the lower housing, and a bore in each of the housings, an improved wear bushing assembly for reducing wear damage to the bores, comprising in combination:

an annular recess formed in the bore of the upper housing, the recess having a downward facing shoulder;

a wear bushing having an upper portion and a lower portion;

the lower portion of the wear bushing having an upper end containing a plurality of fingers, the fingers being spaced apart by slots extending downward from the upper end so as to allow radial deflection of the fingers between an undeflected running-in position and an outward deflected position;

a stop surface in the bore of the lower housing which is engaged by the lower portion as the wear bushing is being run in to limit downward movement of the lower portion in the bore;

a downward facing shoulder on an inner surface on the fingers; and a conical lower end on the upper portion, the lower end having an upward facing shoulder, such that when the upper portion is moved downward relative to the lower portion after the lower portion engages the stop surface, the conical lower end engages the fingers and causes the fingers to deflect outward into the recess below the shoulder in the recess, and causes the upward facing shoulder on the upper portion to engage the downward facing shoulder on the lower portion to prevent the upward movement of the wear bushing.

15. The well assembly according to claim 14 further comprising at least one pin in the bore to prevent rotation of the lower portion of the wear bushing.

16. The well assembly according to claim 14 wherein the shoulders on the upper and lower ends of the upper and lower portions are tapered such that they will slidingly disengage if sufficient upward force is applied to the upper portion.

17. A method for inserting and remotely locking an inner tubular member inside a bore of an outer tubular member of a well, comprising:

providing an annular recess in the bore, the recess having a downward facing shoulder;

providing the inner tubular member with an upper portion and a lower portion;

providing a plurality of radially deflectable fingers on an upper end of the lower portion;

inserting a lower end of the upper portion inside the upper end of the lower portion;

lowering the inner tubular member into the bore with the fingers undeflected; and landing the lower portion on a stop in the bore to stop further downward movement of the lower portion while continuing to move the upper portion downward, causing the fingers to deflect outward under the shoulder to lock the inner tubular member inside the outer tubular member.

* * * * *

UNITED STATES PATENT AND TRADEMARK OFFICE

CERTIFICATE OF CORRECTION

PATENT NO. : 5,762,136

DATED : June 9, 1998

INVENTOR(S) : Iain Macpherson Oswald

It is certified that error appears in the above-indentified patent and that said Letters Patent is hereby corrected as shown below:

Title page, item [73], Assignee: should read -- ABB Vetco Gray Inc.--

Signed and Sealed this

Sixteenth Day of November, 1999

*Attest:*

Q. TODD DICKINSON

*Attesting Officer*

*Acting Commissioner of Patents and Trademarks*